United States Patent [19]

Maruyama et al.

[11] Patent Number: 5,046,334

[45] Date of Patent: Sep. 10, 1991

[54] ELECTROMAGNETIC NEEDLE SELECTOR FOR CIRCULAR KNITTING MACHINES

[75] Inventors: Kakuji Maruyama; Buichi Oda, both of Bunsui, Japan

[73] Assignee: Nagata Seiki Kabushiki Kaisha, Tokyo, Japan

[21] Appl. No.: 528,841

[22] Filed: May 24, 1990

Related U.S. Application Data

[62] Division of Ser. No. 239,591, Sep. 1, 1988, Pat. No. 4,972,686.

[30] Foreign Application Priority Data

| | | | |
|---|---|---|---|
| Oct. 7, 1987 | [JP] | Japan | 62-153607 |
| Oct. 8, 1987 | [JP] | Japan | 62-154200 |
| Dec. 22, 1987 | [JP] | Japan | 62-194389 |

[51] Int. Cl.[5] ..... D04B 9/26; D04B 15/78

[52] U.S. Cl. ..... 66/221

[58] Field of Search ..... 66/25, 75.2, 219, 221

[56] References Cited

FOREIGN PATENT DOCUMENTS 62-15664 4/1987 Japan ..... 66/221

*Primary Examiner*—Wm. Carter Reynolds

*Attorney, Agent, or Firm*—Ladas & Parry

[57] ABSTRACT

An upstanding knitting cylinder carries a multiplicity of needle jacks on its circumference. In order to selectively more the needle jacks up and down on the knitting cylinder during the rotation thereof, a vertical flow of selector fingers capable of engagement with butts on the needle jacks are rigidly mounted to respective sleeves which in turn are rotatably mounted on fixed horizontal shafts disposed in parallel spaced relation to one another in a vertical plane. Disposed opposite the respective sleeves on the fixed shafts are several pairs of electromagnet assemblies which are arranged in two diagonal rows in order to reduce the vertical dimension of the needle selector. An armature secured to each sleeve is held opposite each pair of electromagnet assemblies so as to be alternately attracted thereby, with the consequent bidirectional rotation of the sleeves and, therefore, the pivotal motion of the selector fingers to engage and disengage the needle jack butts. Each electromagnet assembly is constructed to form a closed magnetic loop when energized.

7 Claims, 6 Drawing Sheets

ELECTROMAGNETIC NEEDLE SELECTOR FOR CIRCULAR KNITTING MACHINES

BACKGROUND OF THE INVENTION

This invention relates to an electromagnetically actuated needle selector for circular knitting machines such as those for the production of hosiery, and with the possible capability of creating patterns on the knitted fabric under electronic control.

GB-2138847-A published Oct. 31, 1984 and JP-61-47856-A published Mar. 8, 1986 are hereby cited as the prior art that is believed to be closest to the instant invention. The former application suggests a needle selector including an upright knitting cylinder carrying multiple needle jacks slidably received in as many grooves cut longitudinally in its surface. The needle jacks are to be selectively raised for creating patterns on the fabric being knitted.

For selectively lifting the needle jacks on the knitting cylinder, the application first cited employs a vertical stack of L-shaped selector levers pivotable about a common vertical axis. Each selector lever has a twisted tip at one end for engaging and pushing up the butt of each selected needle jack and carries three permanent magnets in a horizontal row on the other end. Disposed adjacent to said other ends of the selector levers are pairs of electromagnets forming a vertical row. As each pair of electromagnets are alternately excited in opposite directions, the corresponding selector lever is swung back and forth by the attractive and repulsive forces exerted between the pair of electromagnets and the three permanent magnets on the selector lever. The twisted tips of the selector levers will then act on the butts of the needle jacks on the knitting cylinder, which rotates at high speed, to lift the desired needles.

An objection to this prior art needle selector is the large vertical dimension necessitated by the vertical stacking of the pairs of electromagnets. Furthermore, since the self-excited vibration of the electromagnets upon energization, is transmitted directly to the needle jacks via the selector levers, the prior art device generates considerable noise and vibration and the twisted tips of the selector levers are subject to rapid wear. Such vibration is all the more objectionable because it impedes the positive actuation of the selector levers, and hence of the needle jacks, by the electromagnet pairs.

The second mentioned application teaches the use of intermediate drive members which are driven by pairs of electromagnets and which in turn drive selector levers capable of engaging with butts on the needle jacks. The vertical dimension of this second prior art needle selector must also be of necessity so great as to cause inconvenience in handling the bobbins in the use of the knitting machine. Moreover, the construction of this known device is very complex, making its manufacture and adjustment difficult.

SUMMARY OF THE INVENTION

The present invention seeks to provide an improved needle selector which is much more compact in construction than the prior art devices, and which is positive and reliable in operation.

Briefly, the needle selector in accordance with the invention comprises a knitting cylinder rotatable about an axis extending in a first (e.g. vertical) direction, with multiple needle jacks mounted to its surface for independent displacement in the first direction. Adjacent to the knitting cylinder, a plurality of shafts are mounted to frame means and disposed in parallel spaced relation to one another in a plane parallel to the axis of the knitting cylinder, with each shaft extending in a second (e.g. horizontal) direction at right angles to the first direction. Each shaft has a sleeve rotatably fitted thereover. A row of selector fingers extending in the first direction are secured one to each sleeve for selective engagement with the needle jacks on the knitting cylinder, to cause the independent displacement thereof with the bidirectional rotation of the sleeves on the fixed shafts. In order to drive the sleeves on the fixed shafts bidirectionally, a plurality of pairs of electromagnet assemblies are immovably supported by the frame means in opposition with respect to the respective sleeves on the shafts, with each pair of electromagnet assemblies positioned side by side in the first direction. A plurality of armatures are secured one to each sleeve and disposed so that each is opposite a pair of electromagnet assemblies, and so as to be alternately attracted thereby, with the consequent bidirectional rotation of the sleeves on the fixed shafts. Also included are means for forming a closed magnetic circuit for each electromagnet assembly in action together with one associated armature when the electromagnet assembly is energized.

Thus, with the pairs of electromagnet assemblies arranged in two diagonal rows for independently driving the rotary sleeves, it becomes possible to position these sleeves, and therefore the selector fingers thereon, with minimal spacing therebetween. Consequently, the vertical dimension of the needle selector can be drastically reduced than if the electromagnet pairs are arranged in a row in accordance with the prior art.

The above and other features and advantages of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
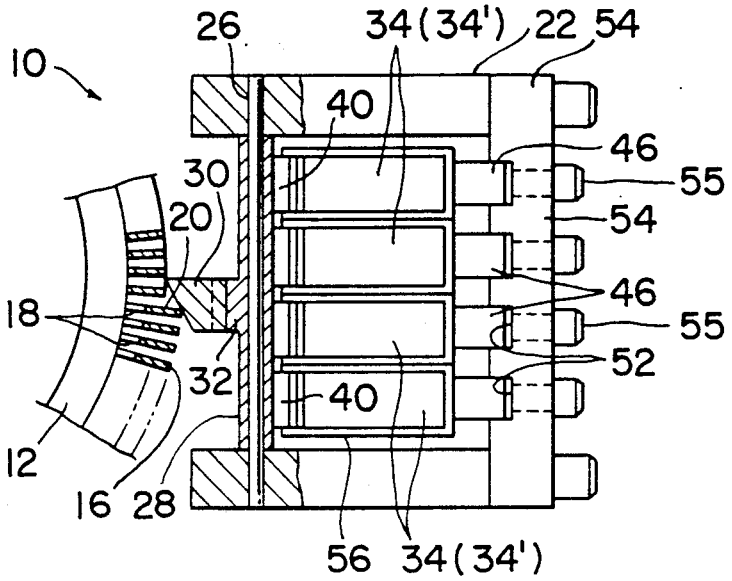
FIG. 1 is a top plan view, with parts shown broken away for clarity, of the electromagnetic needle selector constructed in accordance with the novel concepts of the invention.
Figure 2:
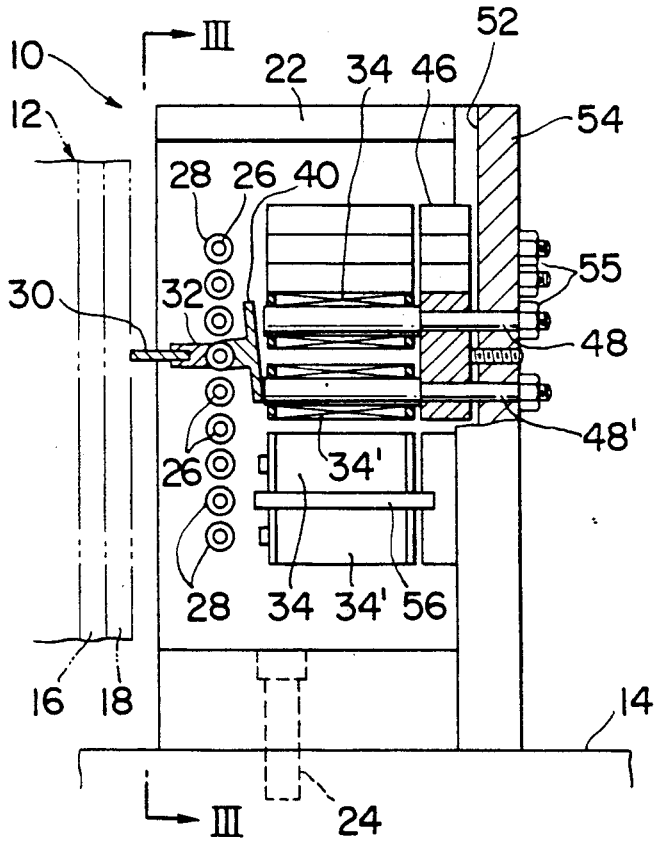
FIG. 2 is a vertical section, with parts shown in elevation for illustrative convenience, through the needle selector of FIG. 1.

As illustrated in both FIGS. 1 and 2, the needle selector 10 embodying the invention, comprises an upstanding knitting cylinder 12 mounted on a platform 14, FIG. 2, of a circular knitting machine for rotation about its own axis extending vertically (first direction). The knitting cylinder 12 has multiple grooves 16 cut longitudinally in its surface for slidably receiving needle jacks 18 each having a butt 20. The needle jacks 18 are to be selectively moved up and down on the knitting cylinder 12 for actuating the needles (not shown) of the knitting machine in a known manner.

Disposed in the immediate vicinity of the knitting cylinder 12 is a generally rectangular support frame 22 for supporting the various working components, set forth hereafter, of the needle selector 10 which functions to cause selective longitudinal displacement of the needle jacks 18 on the knitting cylinder 12. FIG. 2 indicates that the support frame 22 is fastened at 24 to the platform 14.

Figure 3:
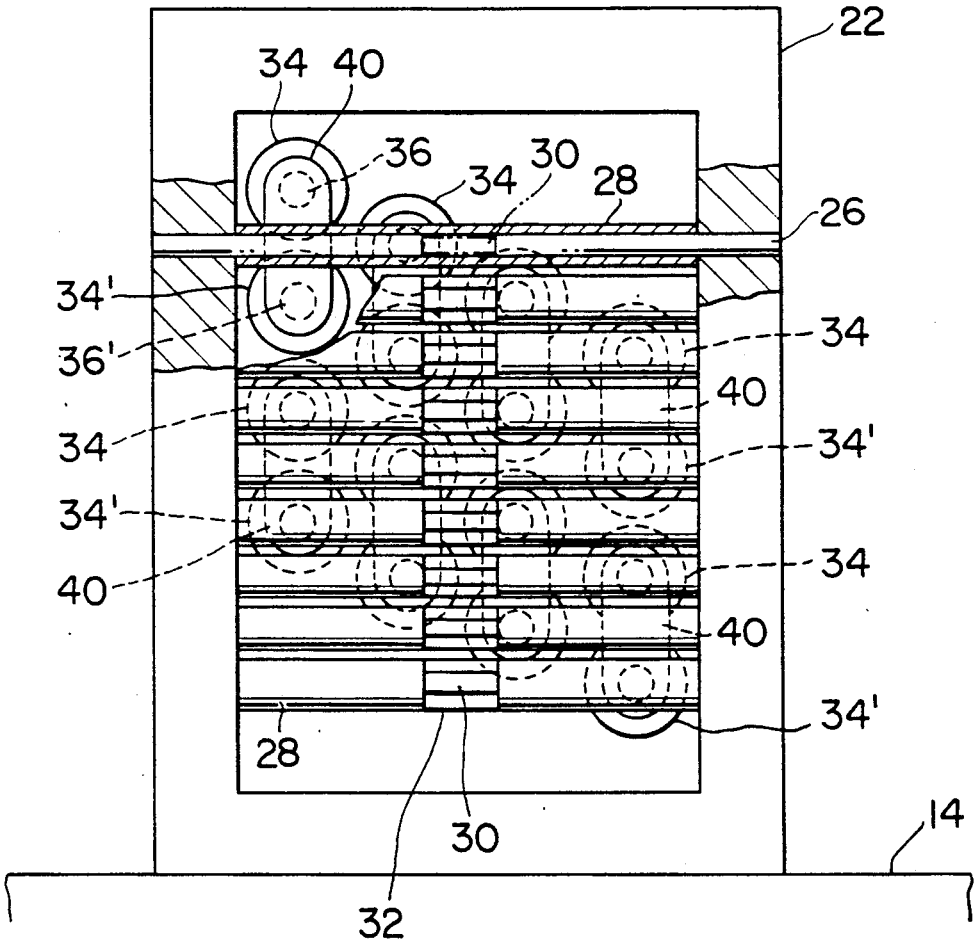
FIG. 3 is an elevation, with parts shown sectioned for clarity, of the needle selector as seen in the direction of the arrows III in FIG. 2, the view explaining the arrangements of the electromagnet assemblies and the selector fingers in particular.

As will be seen also from FIG. 3, the support frame 22 immovably supports a plurality of, eight in this particular embodiment, shafts 26 which extend horizontally (second direction) in parallel to one another and which are all contained in a vertical plane. A plurality of sleeves 28 are rotatably fitted one over each fixed shaft 26. Each sleeve 28 has rigidly but removably mounted thereto, a tapered selector finger 30 extending toward the knitting cylinder 12 for selective engagement with the butts on of the needle jacks 18 thereon. All the selector fingers 30 are disposed at the midpoints of the sleeves 28 and are thereby aligned vertically. Preferably, the selector fingers 30 should be fabricated from ceramic material for wear resistance.

Figure 4:
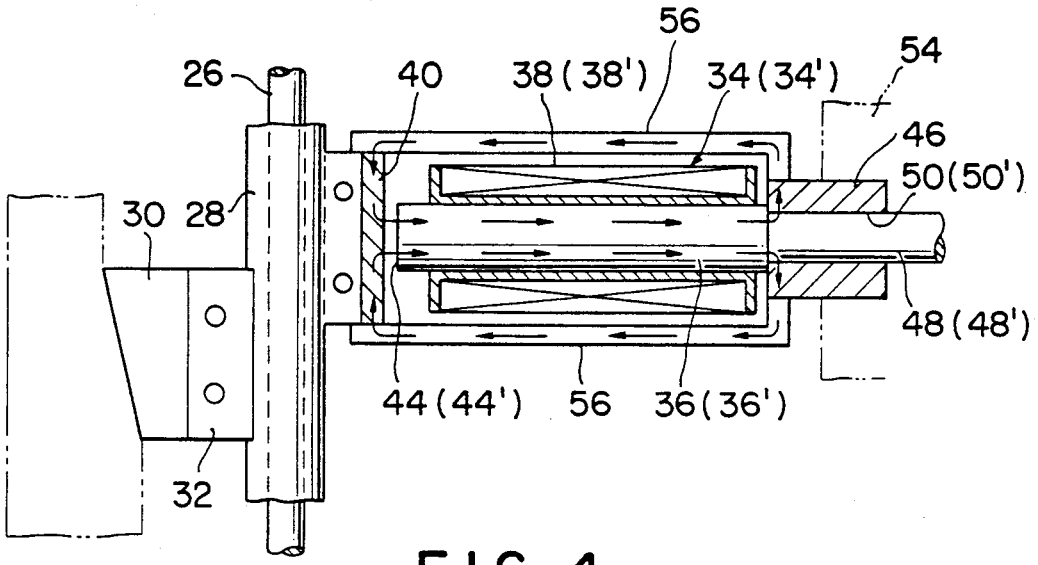
FIG. 4 is an enlarged horizontal section through one of the electromagnet assemblies used in the needle selector of FIGS. 1 and 2, the electromagnet assembly being shown together with one associated selector finger, armature, and means for forming a closed magnetic loop.
Figure 5:
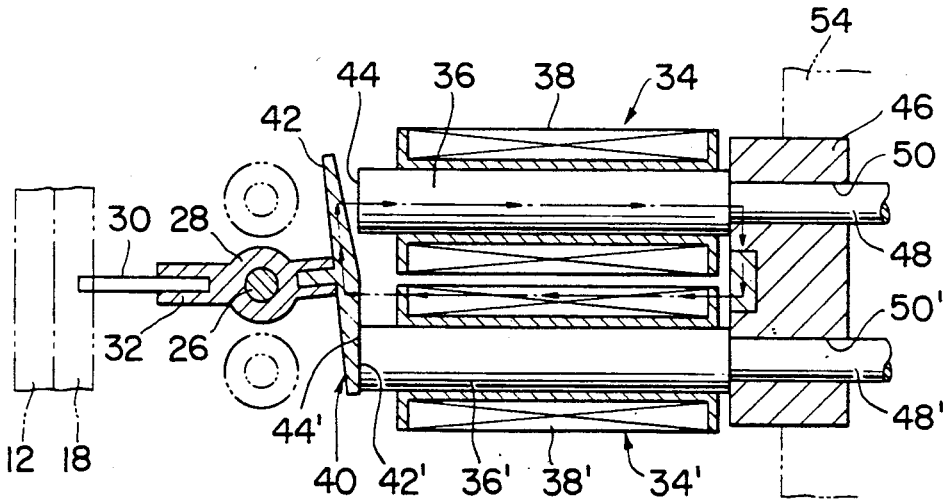
FIG. 5 is an enlarged vertical section through one pair of electromagnet assemblies in the needle selector of FIGS. 1 and 2, also shown together with one associated selector finger, armature, and means for forming closed magnetic loops.
Figure 6:
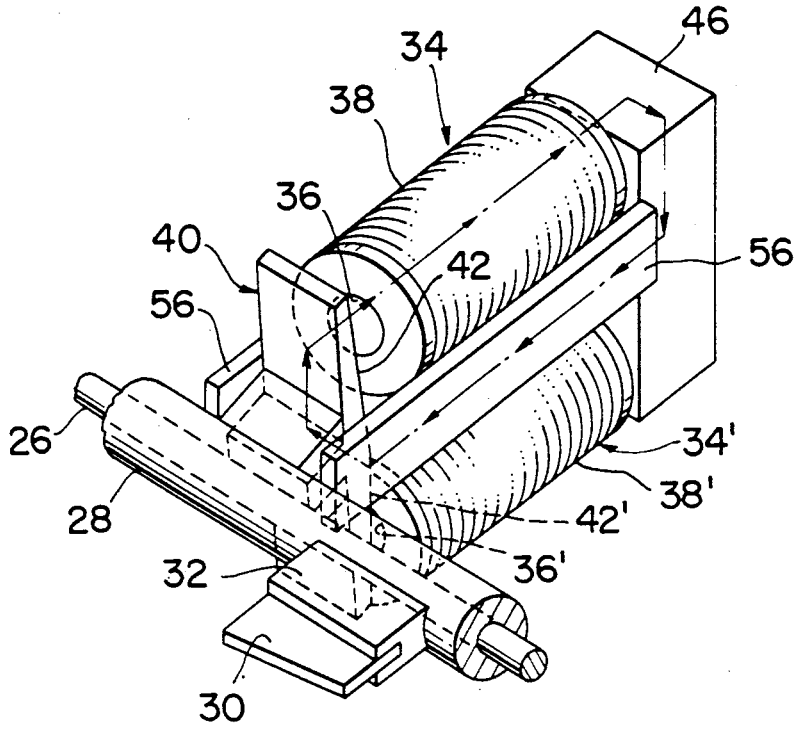
FIG. 6 is a perspective view of the pair of electromagnet assemblies of FIG. 5, also shown together with the same additional means as in FIGS. 4 and 5.

As illustrated on an enlarged scale in FIGS. 4–6, each selector finger 30 is replaceably supported by a generally U-shaped carrier 32 secured to one associated sleeve 28. It will therefore be seen that the selector fingers 30 can pivot up and down with the bidirectional rotation of the associated sleeves 28 on the fixed shafts 26.

Employed for the desired bidirectional rotation of the sleeves 28 are a plurality of, eight in this embodiment, pairs of electromagnet assemblies 34 and 34′ immovably supported within the support frame 22. Each electromagnet assembly 34 or 34′ comprises a magnetic core 36 or 36′ with a coil 38 or 38′ wound thereon. FIG. 6 best illustrates that each pair of electromagnet assemblies 34 and 34′ extend horizontally, with one 34 positioned over the other 34′, and with their ends held opposite one of the rotatable sleeves 28.

As will be understood by referring again to FIG. 3, the eight pairs of electromagnet assemblies 34 and 34′ are arranged in two diagonal rows. It will further be noted that every two pairs of such electromagnet assemblies are in vertical alignment, with the four electromagnet assemblies of each vertical series disposed at substantially the same pitch. Furthermore, the successive vertical series of electromagnet assemblies are vertically displaced at half the pitch from the neighboring series. So arranged, the eight pairs of electromagnet assemblies 34 and 34′ lie opposite the right rotatable sleeves 28, respectively, which are disposed with minimal spacings therebetween.

Such an arrangement of the electromagnet assemblies 34 and 34′ makes it possible to reduce the vertical dimension of the needle selector 10 to a value remarkably less than if such pairs of electromagnets were arranged in a single vertical or slanting row, as has been the case heretofore.

With reference back to FIGS. 4–6 each rotary sleeve 28 has an armature 40 of magnetic material rigidly mounted thereto, in such a position thereon that the armature is opposed to one pair of electromagnet assemblies 34 and 34′ associated with that particular sleeve. Since the upper four sleeves 28, for example, are respectively associated with the upper diagonal row of pairs of electromagnet assemblies 34 and 34′, the armatures 40 are all mounted at different longitudinal positions on these sleeves. The armatures on the lower four sleeves 28 are mounted in corresponding positions thereon.

Each armature 40 is generally T-shaped, as seen in side view as in FIG. 5, having a pair of flat contact surfaces 42 and 42′ for direct contact with the exposed end faces 44 and 44′ of the cores 36 and 36′ of one associated pair of electromagnet assemblies 34 and 34′. The pair of contact surfaces 42 and 42′ are formed at an angle to each other for close face to face contact with the respective magnetic cores 36 and 36′.

Thus, as each pair of electromagnet assemblies 34 and 34′ is alternately excited with current pulses under the control of an electronic control circuit, not shown, the armature 40 will pivot thereby, bidirectionally driving the associated sleeve 28 through a predetermined angle around the fixed shaft 26. Thereupon the selector finger 30 on the sleeve 28 will pivot up and down about the shaft 26.

The invention further features means for forming a closed magnetic circuit for each electromagnet assembly 34 or 34′ in action together with one associated armature 40 when it is being energized, in order to assure more reliable operation of the needle selector 10. Such means include an end block 46, seen in FIGS. 1, 2 and 4–6, of magnetic material in contact with those ends of the cores 36 and 36′ of each pair of electromagnet assemblies 34 and 34′ which are oriented away from the knitting cylinder 12. These ends of the cores 36 and 36′ have extensions 48 and 48′ of reduced diameter extending through bores 50 and 50′ in the end block 46.

As clearly seen in FIGS. 1 and 2, the eight end blocks 46 employed in this embodiment (corresponding to the eight pairs of electromagnet assemblies) are engaged in four vertical grooves 52 formed in a support plate 54 of nonmagnetic material removably attached to the support frame 22. The core extensions 48 and 48' extend through the support plate 54 and have nuts 55 engaged on their threaded ends protruding from the support plate. Thus the support plate 54 with the eight pairs of electromagnet assemblies 34 and 34' thereon, is readily removable from the support frame 22 as required.

An inspection of FIGS. 4-6 will reveal that each end block 46 has a pair of arms 56 of magnetic material formed on its opposite sides and disposed on the opposite sides of one associated pair of electromagnet assemblies 34 and 34'. The distal ends of the pair of arms 56 are held against the opposite sides of one associated armature 40 so as not to interfere with its pivotal movement. Therefore, upon excitation of the coil 38 or 38', a closed magnetic loop is formed for each electromagnet assembly by the core 36 or 36', armature 40, end block 46 and arms 56, as indicated by the arrows in FIGS. 4-6.

OPERATION

In the operation of the needle selector 10 constructed as in the foregoing, the knitting cylinder 12 with the needle jacks 18 thereon will rotate at high speed for the production of the desired knitted fabric. During such rotation of the knitting cylinder 12 the eight pairs of electromagnet assemblies 34 and 34' are to be selectively energized with current pulses as dictated by a pattern signal produced by a preprogrammed electronic control device which is not shown as it falls outside the scope of the invention. Each armature 40 will have its two contact surfaces 42 and 42' alternately attracted by the associated pair of electromagnet assemblies 34 and 34'. When the contact surface 42 of the armature 40 is attracted by the core 36, for example, the other contact surface 42' will be repelled by the core 36'.

When the armatures 40 are so activated by the associated pairs of electromagnet assemblies 34 and 34', with the consequent rotation of the corresponding sleeves 28 on the fixed shafts 26, the selector fingers 30 on these sleeves will act selectively on the butts 20 of the needle jacks 18 thereby creating the desired pattern on the fabric being knitted.

It is to be appreciated that each electromagnet assembly 34 or 34' on being energized, forms a closed magnetic circuit in combination with the armature 40, end block 46 and arms 56. The closed magnetic circuits serve the dual purpose of augmenting the forces exerted by each pair of electromagnet assemblies 34 and 34' on the associated armature 40 and of preventing mutual magnetic interference between the electromagnet assemblies.

The electromagnet assemblies 34 and 34' will exert greater attractive forces on the armatures 40 as the contact surfaces 42 and 42' of the armatures are angled for close face to face contact with the ends 44 and 44' of the magnetic cores 36 and 36'. Noise production will also be curtailed appreciably. It is also an advantage that, being fabricated from ceramic material, the selector fingers 30 will not suffer any rapid wear despite their frequent forced contacts with the butts 20 of the needle jacks 18.

SECOND FORM

Figure 7:
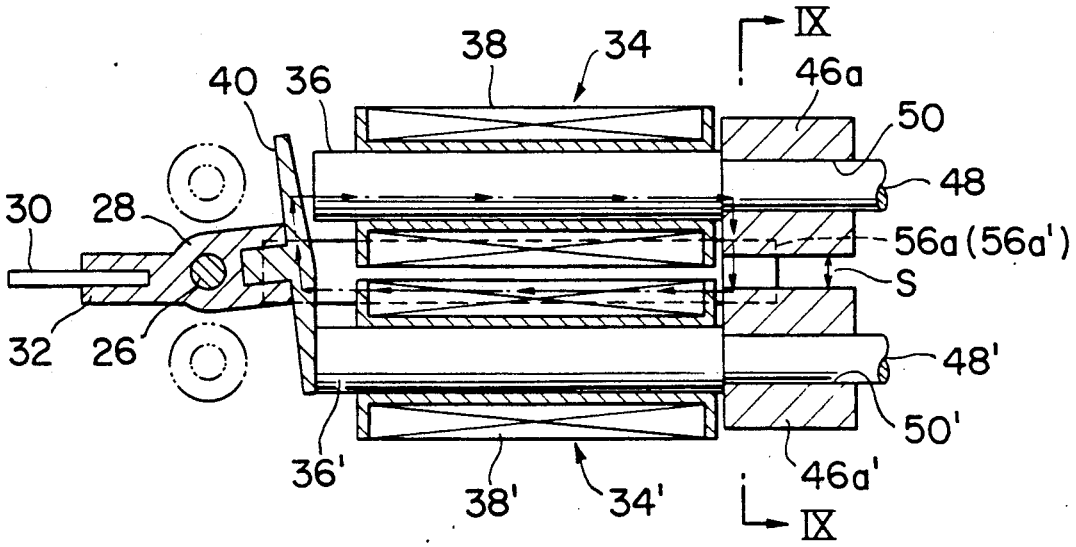
FIG. 7 is a view similar to FIG. 5 except that the pair of electromagnet assemblies are shown provided with an alternative means for forming closed magnetic loops.
Figure 8:
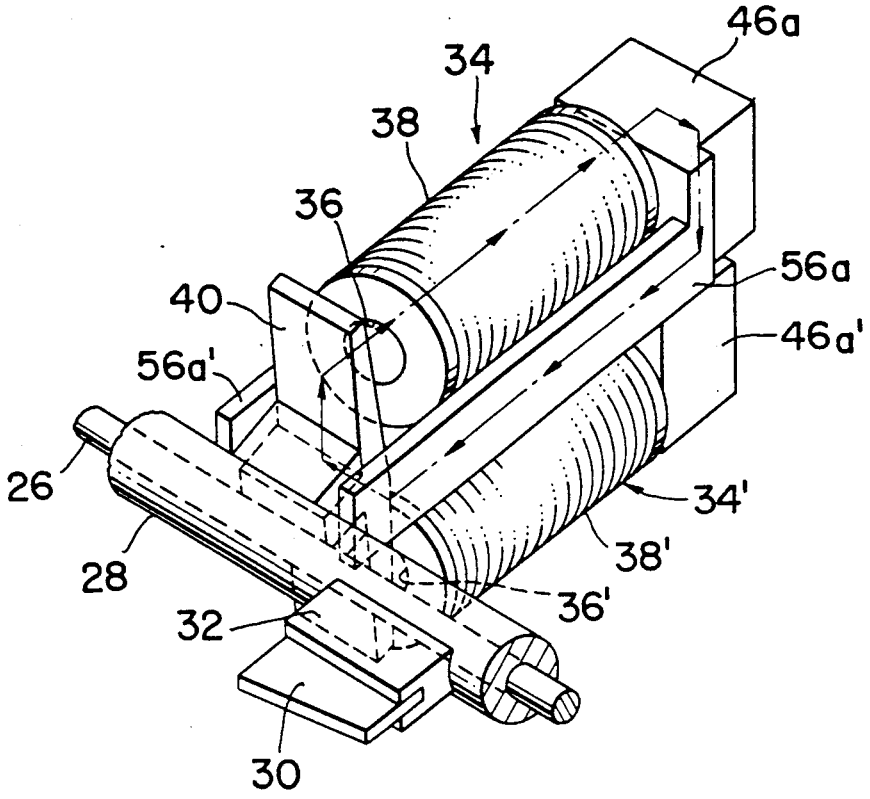
FIG. 8 is a view similar to FIG. 6 except that the pair of electromagnet assemblies are shown provided with the alternative means of FIG. 7.
Figure 9:
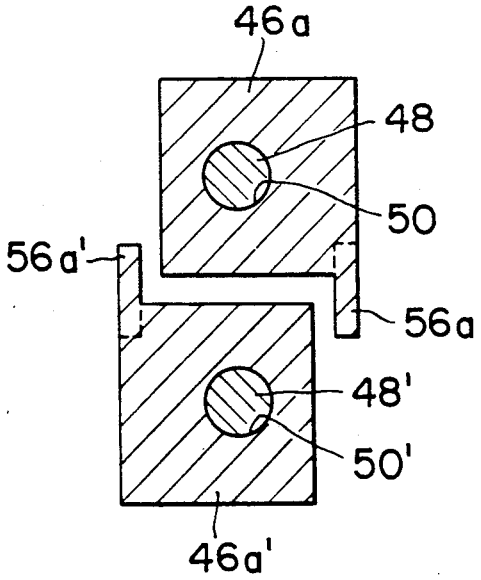
FIG. 9 is a section taken along the line IX-IX in FIG. 7 and showing the pair of end blocks of magnetic material forming parts of the alternative means for forming closed magnetic loops.

FIGS. 7-9 illustrate alternative means for forming a closed magnetic circuit for each electromagnet assembly 34 or 34' in a needle selector constructed as in FIGS. 1-3. The alternative means feature a pair of end blocks **46*a* and 46*a'* of magnetic material employed in substitution for the common end block 46 used in the preceding embodiment for each pair of electromagnet assemblies. Thus the pair of end blocks 46*a* and 46*a'* are in contact with the right hand ends, as seen in FIG. 7, of the magnetic cores 36 and 36', respectively, of each pair of electromagnet assemblies 34 and 34'. A spacing S, FIG. 7, exists between the pair of end blocks 46*a* and 46*a'*. These end blocks are bored at 50 and 50' for receiving the extensions 48 and 48' of the cores 36 and 36. The pair of end blocks 46*a* and 46*a'* have a pair of arms 56*a* and 56*a'* formed on their opposite sides. These arms extend from the end blocks 46*a* and 46*a'* along both sides of each pair of electromagnet assemblies 34 and 34' toward the other ends of the cores 36 and 36'. The distal ends of the arms 56*a* and 56*a'* are held against the opposite sides of the armature 40 as in the preceding embodiment Preferably, and as shown, the arms 56*a* and 56*a'* may be formed in one piece with the respective end blocks 46*a* and 46*a'***.

The separation of each end block 46 of the preceding embodiment into the two smaller units **46*a* and 46*a'* makes it possible to form a more independent magnetic circuit for each of the electromagnet assemblies 34 and 34'** Leakage flux can thus be reduced to a minimum.

THIRD FORM

Figure 10:
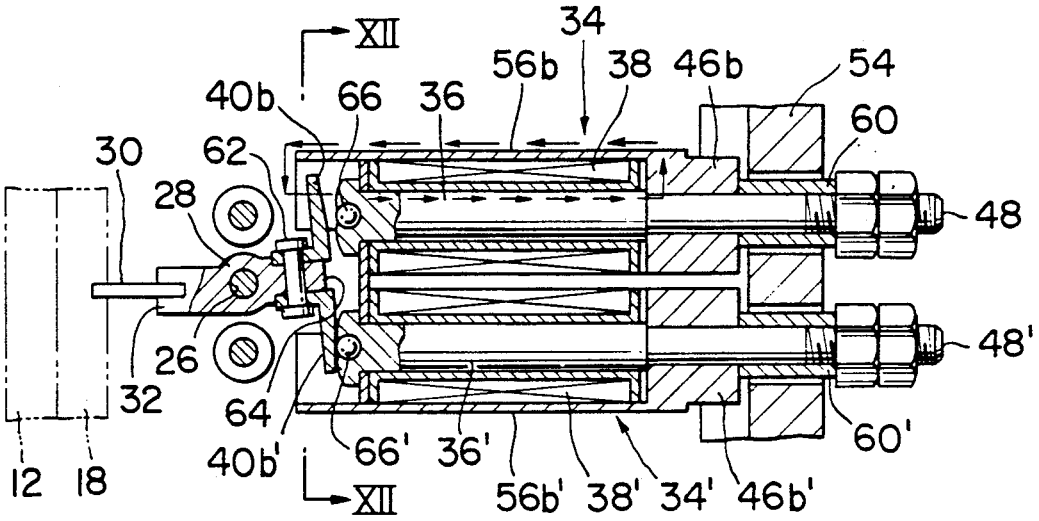
FIG. 10 is a vertical section through a modified pair of electromagnet assemblies and other associated parts, altogether constituting a different embodiment of the invention.
Figure 11:
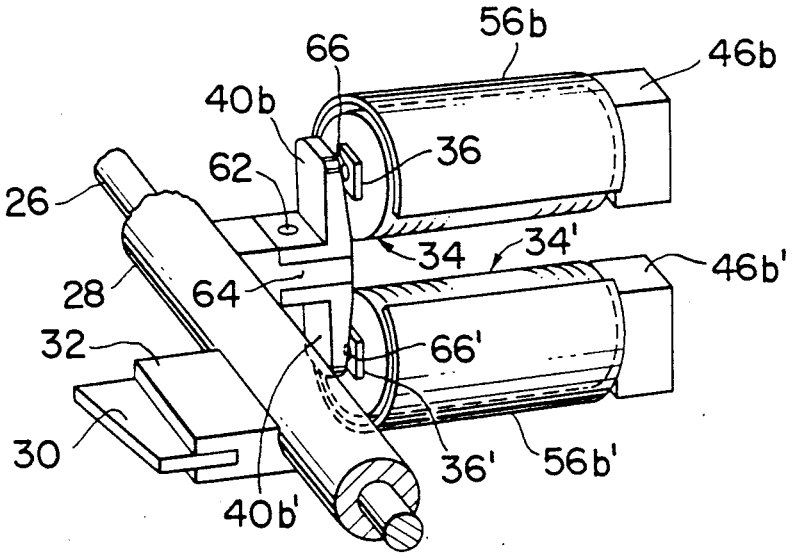
FIG. 11 is a perspective view of the embodiment shown in FIG. 10.
Figure 12:
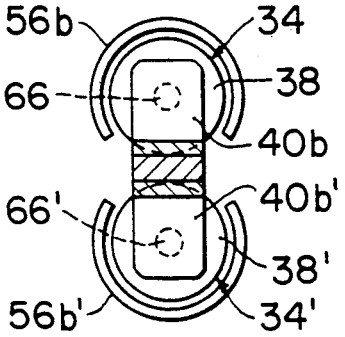
FIG. 12 is a section taken along the line XII-XII of FIG. 10.

In FIGS. 10-12 is shown a further preferred embodiment of the invention, which also employs separate end blocks **46*b* and 46*b'* for each pair of electromagnet assemblies 34*a* and 34*a'*, respectively. However, the pair of arms 56 of the FIGS. 1-6 embodiment and the pair of arms 56*a* and 56*a'* of the FIGS. 7-9 embodiment are replaced by a pair of substantially tubular members 56*b* and 56*b'* of magnetic material encircling approximately half the circumferences of the electromagnet assemblies 34*a* and 34*a'*, respectively. The tubular members 56*b* and 56*b'* are coupled each at one end to the end blocks 46*b* and 46*b'*, respectively. The other ends of the tubular members 56*b* and 56*b'* are disposed adjacent to the associated armature. A closed magnetic circuit can thus be formed for each electromagnet assembly, as indicated by the arrows in FIG. 10. As shown also in FIG. 10, the extensions 48 and 48' of the magnetic cores 36*a* and 36*a'* may be magnetically isolated from the support plate 54 by fitting sleeves 60 and 60'** of nonmagnetic material thereover.

In this embodiment, each armature is divided into a pair of separate halves **40*b* and 40*b'* to be attracted respectively by the associated pair of electromagnet assemblies 34*a* and 34*a'*. Each L-shaped as seen in a side view as in FIG. 10, the pair of armature halves 40*b* and 40*b'* are affixed by a rivet 62 or like fastener element to the opposite sides of a tongue 64 formed on the rotary sleeve 28 on each fixed shaft 26. It will therefore be seen that two completely independent magnetic circuits are formed for each pair of electromagnet assemblies 34*a* and 34*a'***, so that the latter are more magnetically independent of each other.

This embodiment further features balls 66 and 66' of steel or like magnetic material which are partly embedded in the end faces of the magnetic cores 36 and **36*a'* of each pair of electromagnet assemblies 34*a* and 34*a'*. These balls are to make direct contact with the pair of armature havles 40*b* and 40*b'***, respectively.

The balls 66 and 66' are effective to reduce the production of residual magnetism on the armature halves **40*b* and 40*b'*, as well as the generation of noise when the armature halves are attracted. As an additional advantage, the armature halves 40***b* and 40*b*′ will readily move out of contact with the balls 66 and 66′ upon deenergization of the coils 38 and 38′, even if, as is frequently the case with knitting machines, the electromagnets and armatures are smeared with lubricating oil.

What is claimed is:

1. An electromagnetic needle selector for circular knitting machines, comprising:

(a) a knitting cylinder rotatable about an axis extending vertically;

(b) a multiciplicity of needle jacks mounted to the knitting cylinder for independent vertical displacement;

(c) fixed frame means adjacent to the knitting cylinder;

(d) a plurality of horizontal shafts mounted to the frame means and disposed in parallel spaced relation to one another in a plane parallel to the axis of the knitting cylinder;

(e) a plurality of sleeves rotatably fitted one over each fixed shaft;

(f) a plurality of selector fingers secured one to each sleeve and all aligned vertically, the selector fingers being capable of selective engagement with the jacks on the knitting cylinder;

(g) a plurality of pairs of electromagnet assemblies immovably supported by the frame means in opposed relation to the respective sleeves on the shafts, with each pair of electromagnet assemblies positioned side by side vertically, each of the electromagnet assemblies comprising a magnetic core having a pair of opposite ends, and a coil wound on the magnetic core;

(h) a plurality of armatures secured one to each sleeve and disposed one opposite each pair of electromagnet assemblies so as to be alternately attracted by one ends of the magnetic cores, with the consequent bidirectional rotation of the sleeves on the fixed shafts, and (i) means for forming a closed magnetic circuit for each electromagnet assembly in action together with one associated armature when the electromagnet assembly is being energized, said closed magnetic circuit forming means comprising;

(j) a pair of end blocks of magnetic material in contact respectively with the other ends of the cores of each pair of electromagnet assembly; and (k) a pair of substantially tubular members of magnetic material each encircling approximately half the circumference of the coil of one electromagnet assembly, each substantially tubular member being coupled at one end to one associated end block and having another end disposed adjacent to one associated armature.

2. The electromagnetic needle selector of claim 1, wherein each electromagnet assembly has a ball of magnetic material embedded in the magnetic core thereof for direct contact with one associated armature.

3. The electromagnetic needle selector of claim 2, wherein the ball is of steel.

4. The electromagnetic needle selector of claim 1, wherein every two pairs of electromagnet assemblies are aligned vertically.

5. The electromagnetic needle selector of claim 4, wherein each series of four electromagnet assemblies aligned vertically are disposed with substantially the same pitch, and wherein each series of electromagnet assemblies are vertically disposed by half the pitch from the neighboring series of electromagnet assemblies.

6. The electromagnetic needle selector of claim 1, wherein the selector fingers are of ceramic material.

7. The electromagnetic needle selector of claim 1, wherein the selector fingers are removably mounted to the sleeves.

* * * * *